US009740127B2

(12) United States Patent
Komada et al.

(10) Patent No.: US 9,740,127 B2
(45) Date of Patent: Aug. 22, 2017

(54) TONER

(71) Applicant: KYOCERA Document Solutions Inc., Osaka-shi, Osaka (JP)

(72) Inventors: Ryotaro Komada, Osaka (JP); Masami Tsujihiro, Osaka (JP); Jun Hioki, Osaka (JP); Hideharu Hori, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/047,832

(22) Filed: Feb. 19, 2016

(65) Prior Publication Data

US 2016/0252835 A1 Sep. 1, 2016

(30) Foreign Application Priority Data

Feb. 27, 2015 (JP) ..... 2015-038032

(51) Int. Cl.
*G03G 9/093* (2006.01)

(52) U.S. Cl.
CPC ..... *G03G 9/09314* (2013.01); *G03G 9/09321* (2013.01); *G03G 9/09328* (2013.01)

(58) Field of Classification Search
CPC ..... G03G 9/08782; G03G 9/08755; G03G 9/08795; G03G 9/08797; G03G 9/09371
See application file for complete search history.

(56) References Cited

U.S. PATENT DOCUMENTS 4,980,257 A * 12/1990 Anno ..... G03G 9/0825 428/407
2005/0271964 A1 12/2005 Etou et al.

FOREIGN PATENT DOCUMENTS

JP 2004-138985 A 5/2004

* cited by examiner

*Primary Examiner* — Peter Vajda
(74) *Attorney, Agent, or Firm* — Studebaker & Brackett PC

(57) ABSTRACT

A toner includes a plurality of toner particles each including a toner core and a shell layer disposed over the surface of the toner core. The shell layer includes a thermosetting portion substantially composed of a water-insoluble thermosetting resin and a thermoplastic portion substantially composed of a water-insoluble thermoplastic resin. At least a part of the thermoplastic portion has a shape of a film with projections and recesses and is located on the surface of the toner core. At least a part of the thermosetting portion is located on the thermoplastic portion. The part of the thermosetting portion located on the thermoplastic portion has a shape of a film along the shape of the thermoplastic portion.

16 Claims, 1 Drawing Sheet

TONER

INCORPORATION BY REFERENCE

The present application claims priority under 35 U.S.C. §119 to Japanese Patent Application No. 2015-038032, filed on Feb. 27, 2015. The contents of this application are incorporated herein by reference in their entirety.

BACKGROUND

The present disclosure relates to toners. More particularly, the present disclosure relates to a capsule toner.

Toner particles included in a capsule toner each have a core and a shell layer (capsule layer) disposed over a surface of the core. A capsule toner has been known for example that includes toner particles each having a core that has a softening temperature of at least 40° and no greater than 150° C.

SUMMARY

A toner according to the present disclosure includes a plurality of toner particles each including a core and a shell layer disposed over a surface of the core. The shell layer includes a thermosetting portion substantially composed of a water-insoluble thermosetting resin and a thermoplastic portion substantially composed of a water-insoluble thermoplastic resin. At least a part of the thermoplastic portion has a shape of a film with projections and recesses and is located on the surface of the core. At least a part of the thermosetting portion is located on the thermoplastic portion. The part of the thermosetting portion located on the thermoplastic portion has a shape of a film along the shape of the thermoplastic portion.

DETAILED DESCRIPTION

Figure 1:
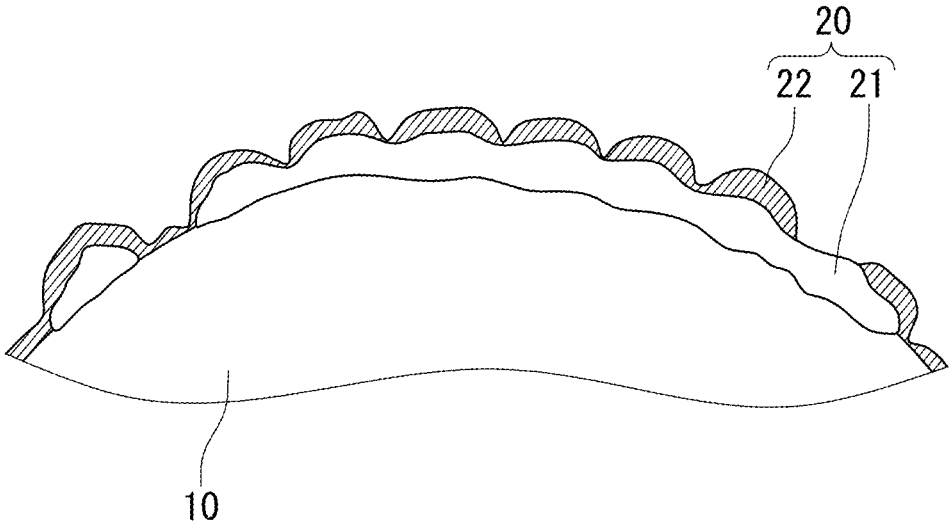
FIG. 1 illustrates a part of a toner particle (specifically, vicinity of a surface of a toner core) included in a toner according to an embodiment of the present disclosure.

Detailed description will be made below about an embodiment of the present disclosure. Unless otherwise stated, evaluation results (for example, values indicating shape and physical properties) for a powder (specific examples include toner cores, resin particles, toner mother particles, external additive, and toner) are number averages of values measured for a suitable number of particles that are selected as average particles within the powder.

Unless otherwise stated, the number average particle size of the powder is a number average value of an equivalent circular diameter of a primary particle (diameter of a circle having the same area of a projected area of a particle) measured using a transmission electron microscope (TEM). Unless otherwise stated, a measured value of a volume median diameter ($D_{50}$) is a value measured using Coulter Counter Multisizer 3 produced by Beckman Coulter, Inc.

In the present description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof. Furthermore, the term "(meth)acryl" is used as a generic term for both acryl and methacryl.

A toner according to the present embodiment can be favorably used as for example a positively chargeable toner for development of an electrostatic latent image. The toner in the present embodiment is a powder formed by a large number of toner particles (particles each having features described later). The toner may be used as a one-component developer. Alternatively, the toner may be mixed with a carrier using a mixer (for example, a ball mill) to prepare a two-component developer. In order to form a high-quality image, a ferrite carrier is preferably used as the carrier. In order to form a high-quality image durable for a long period of time, magnetic carrier particles are preferably used each of which includes a carrier core and a resin layer that cavers the carrier core. In a situation in which the magnetic carrier particles are produced, the carrier core may be formed by a magnetic material (i.e., ferrite) or a resin in which the magnetic particles are dispersed. Alternatively, the magnetic particles may be dispersed in the resin layer covering the carrier core. In order to form a high-quality image, the amount of the toner contained in the two-component developer is preferably at least 5 parts by mass and no greater than 15 parts by mass relative to 100 parts by mass of the carrier core.

The toner particles included in the toner according to the present embodiment each include a core (toner core) and a shell layer (capsule layer) disposed over a surface of the toner core. An external additive may be added to the surfaces of the shell layers (or surface regions of the toner cores uncovered by the shell layers). A plurality of shell layers may be layered over the surface of each toner core. The external additive may be omitted in a situation in which such an additive is not necessary. Hereinafter, the term "toner mother particles" is used to refer to toner particles prior to treatment with an external additive. The term "shell material" is used to refer to a material used to form the shell layers.

The toner according to the present embodiment can be used to form an image by for example an electrophotographic apparatus (image forming apparatus). The following describes an example of a method by which the electrophotographic apparatus forms an image.

An electrostatic latent image based on image data is formed first on a photoreceptor. Next, the formed electrostatic latent image is developed using a developer that contains a toner. In the developing process, a charged toner is caused to adhere to the electrostatic latent image such that a toner image is formed on the photosensitive member. In a subsequent transfer process, the toner on the photoreceptor is transferred onto a transfer belt and thereafter the toner image on the transfer belt is transferred onto a recording medium (for example, paper). After transfer, the toner is heated in order to fix the toner to the recording medium. Through the method described above, an image is formed on the recording medium. A full-color image can for example be formed by superposing toner images of four different colors: black, yellow, magenta, and cyan.

The toner according to the present embodiment has the following features (1) and (2).

(1) The toner includes toner particles each including a toner core and a shell layer disposed over the surface of the toner core.

(2) The shell layer includes a thermosetting portion substantially composed of a water-insoluble thermosetting resin and a thermoplastic portion substantially composed of a water-insoluble thermoplastic resin. At least a part of the thermoplastic portion has a shape of a film with projections and recesses and is located on the surface of the toner core. At least a part of the thermosetting portion is located on the thermoplastic portion. The part of the thermosetting portion located on the thermoplastic portion has a shape of a film along the shape of the thermoplastic portion. The thermosetting portion and the thermoplastic portion may each contain, in addition to the corresponding resin, an additive dispersed in the resin.

Figure 2:
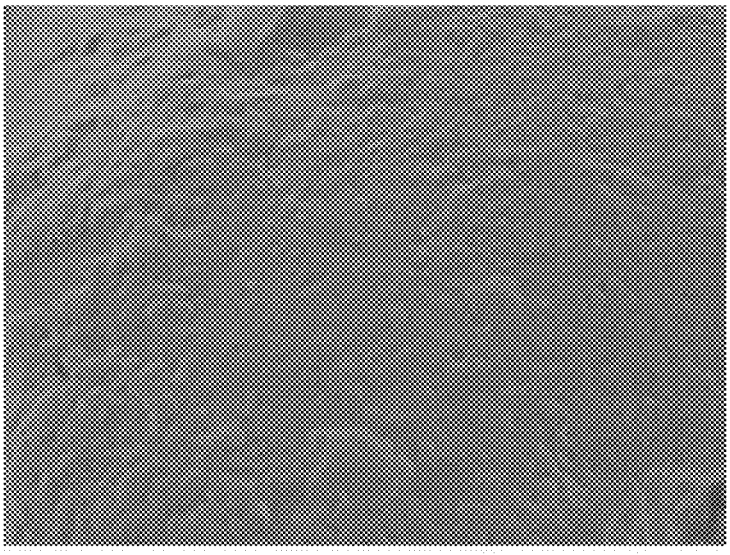
FIG. 2 is a scanning electron microscope (SEM) photograph of a surface of a shell layer of a toner particle included in the toner in the embodiment of the present disclosure.

The following describes an example of the toner particles contained in the toner having features (1) and (2) with reference to FIGS. 1 and 2. FIG. 1 is an enlarged diagram of a part of a toner particle (specifically, vicinity of a surface of a toner core). FIG. 2 is a scanning electron microscope (SEM) photograph of a surface of a shell layer.

As illustrated in FIG. 1, the toner particle includes a toner core 10 and a shell layer 20 disposed over the surface of the toner core 10. The shell layer 20 includes a thermoplastic portion 21 and a thermosetting portion 22. The thermoplastic portion 21 has a shape of a film fragment with projections and recesses and is located on the surface of the toner core 10. The thermoplastic portion 21 has a surface having a granular appearance. A part of the thermosetting portion 22 located on the thermoplastic portion 21 has a shape of a film fragment along the shape of the thermoplastic portion 21. The part of the thermosetting portion 22 located on the thermoplastic portion 21 has a granular appearance corresponding to the thermoplastic portion 21, as presented in FIG. 2. In a region of the surface of the toner core 10 in which no thermoplastic portion 21 is present, the thermosetting portion 22 is directly disposed on the surface of the toner core 10. The thermoplastic portion 21 is partially embedded in the toner core 10. By causing the thermoplastic portion 21 to adhere to the toner core 10 by for example a mechanical impact force, a bottom part (a part close to the toner core 10) of the thermoplastic portion 21 can be embedded in the toner core 10. The thermoplastic portion 21 has a shape for example in which resin particles are melt and spread over the surface of the toner core 10. The thermosetting portion 22 may be a coating film, for example.

Feature (1) is advantageous in terms of improving high-temperature preservability of a toner. Specifically, the shell layers covering the toner cores are thought to increase high-temperature preservability of the toner.

Feature (2) is advantages in terms of improving high-temperature preservability, charge decay characteristics, resistance to drum adhesion, and transfer efficiency of the toner. Operation and advantages obtained through feature (2) will be described below.

In the toner having feature (2), the shell layers each include a thermosetting portion substantially composed of a water-insoluble thermosetting resin and a thermoplastic portion substantially composed of a water-insoluble thermoplastic resin. The above configuration of the shell layers can improve both high-temperature preservability and fixability of the toner. Specifically, it is thought that the thermoplastic resin improves fixability (particularly, low-temperature fixability) of the toner while the thermosetting resin improves high-temperature preservability of the toner. Containment of a thermoplastic resin in the shell layer can result in easy and uniform formation of shell layers containing a thermosetting resin on the surfaces of toner cores.

In a situation in which shell layers contain a large amount of a water-soluble resin, toner particles are liable to absorb water. When the toner particles absorb water molecules, electric conductivity tends to increase at the surfaces of the toner particles while charge retentivity of the toner particles tends to decrease. Decreased charge retentivity of the toner particles is thought to decrease the charge of the toner to make it difficult to form a high-quality image using the toner.

In a transfer process according to the Carlson method, it often takes 0.1 seconds or more and 1.0 second or less from time when a toner adheres to a photoreceptor to time when the toner is transferred to a transfer belt (primary transfer). In a situation in which the charge of the toner decreases, the toner hardly moves due to the presence of an electric field, thereby resulting in tendency to decrease transfer efficiency. Similarly, transfer efficiency tends to decrease in secondary transfer of the toner (transfer from a transfer belt to a recording medium).

In the toner having feature (2), the shell layers each include the thermosetting portion substantially composed of a water-insoluble thermosetting resin and the thermoplastic portion substantially composed of a water-insoluble thermoplastic resin. The above configuration of the shell layer can reduce the amount of a water-soluble resin contained in the shell layer. For the above reason, the toner particles of the toner having feature (2) can be inhibited from absorbing water (in turn, the aforementioned charge decay and the like) and improve transfer efficiency. In order to inhibit the toner particles from absorbing water (in turn, the aforementioned charge decay and the like), it is preferable that the shell layer contain no water-soluble resin.

When resin particles desorb from the shell layer due to degradation of the shell layer or the like, the desorbed resin particles is liable to contaminate a carrier to decrease a charge of the toner. When the shell layers peel off, the toner tends to adhere to a surface of a photosensitive drum.

In the toner having feature (2), at least a part of the thermoplastic portion has a shape of a film with projections and recesses and is located on the surface of the toner core. At least a part of the thermosetting portion is located on the thermoplastic portion. The part of the thermosetting portion located on the thermoplastic portion has a shape of a film along the shape of the thermoplastic portion. It is thought that the resin particles hardly desorb from the shell layer in the presence of the thermosetting portion entering into the recesses of the thermoplastic portion to improve resistance to drum adhesion.

In order to inhibit resin desorption from the shell layer, it is preferable that the surface of the toner core is partially uncovered by the thermoplastic portion and the thermosetting portion of the shell layer is formed on both the surface of the toner core (a part uncovered by the thermoplastic portion) and the surface of the thermoplastic portion. In order to improve high-temperature preservability of the toner and inhibit resin desorption from the shell layers, it is preferable that the thermosetting portion of the shell layer has a higher coverage on the surface region of the toner core than the thermoplastic portion of the shell layer. In order to improve high-temperature preservability of the toner, it is preferable that the thermoplastic portion of the shell layer covers 50% or more area in the entire surface region of the toner core and the thermosetting portion of the shell layer is directly or indirectly covers 80% or more area in the entire surface region of the toner core. The phrase "the thermosetting portion indirectly covers a surface region of the toner core" means that the thermosetting portion is present on the thermoplastic portion that is in contact with the toner core (the thermoplastic portion and the thermosetting portion are layered in order on the toner core).

The toner according to the present embodiment includes toner particles (hereinafter referred to as toner particles of the present embodiment) that have both features (1) and (2). The toner including the toner particles of the present embodiment is thought to be excellent in high-temperature preservability, charge decay characteristics, resistance to drum adhesion, and transfer efficiency (see Table 2 which will be referred to later). In order to improve high-temperature preservability, charge decay characteristics, resistance to drum adhesion, and transfer efficiency of the toner, the toner preferably includes the toner particles of the present embodiment at a rate of 80% by number or more, more preferably 90% by number or more, and particularly more preferably 100% by number.

In feature (2), the shell layer may contain a resin that is neither a water-insoluble thermoplastic resin nor a water-insoluble thermosetting resin. However, in order to improve high-temperature preservability, charge decay characteristics, resistance to drum adhesion, and transfer efficiency of the toner, it is preferable that 80% by mass or more, more preferably 90% by mass, and particularly preferably 100% by mass of a resin contained in the shell layer is a water-insoluble thermoplastic resin or a water-insoluble thermosetting resin.

Hereinafter, the toner cores (a binder resin and an internal additive), the shell layers, and the external additive will be described in order. Non-essential components (for example, a colorant, a releasing agent, a charge control agent, and a magnetic powder) may not be contained in accordance with the intended use of the toner.

[Toner Cores]

The toner cores each contain a binder resin. The toner cores may each optionally contain an internal additive (for example, a colorant, a releasing agent, a charge control agent, and a magnetic powder).

(Binder Resin)

The binder resin is usually a main component (for example, at least 85% by mass) of the toner core. Therefore, properties of the binder resin are thought to have a large influence on overall properties of the toner core. The use of a combination of a plurality of resins as the binder resin can result in adjustment of properties of the binder resin (specific examples include a hydroxyl value, an acid value, Tg, and Tm). The toner cores have a strong tendency to be anionic in a situation in which the binder resin has an ester group, a hydroxyl group, an ether group, an acid group, or a methyl group, and have a strong tendency to be cationic in a situation in which the binder resin has an amino group or an amide group. In order that the binder resin is strongly anionic, the binder resin preferably has a hydroxyl value (measured in accordance with JIS K-0070) and an acid value (measured in accordance with JIS K-0070) that are each at least 10 mg KOH/g, and more preferably each at least 20 mg KOH/g.

The binder resin may preferably be a resin having a group selected from the group consisting of an ester group, a hydroxyl group, an ether, an acid group, and a methyl group and more preferably a resin having either or both a hydroxyl group and a carboxyl group. A binder resin having a functional group such as described above readily reacts with a shell material to form chemical bonds. Formation of chemical bonds between the binder resin and the shell material ensures strong bonding between the toner cores and the shell layers. Also, the binder resin preferably has a functional group including active hydrogen in molecules thereof.

The binder resin preferably has a glass transition point (Tg) that is no greater than a curing onset temperature of the shell material. It is thought that as a result of using a binder resin having Tg such as described above, fixability of the toner tends to be sufficient even during high speed fixing. Tg of the binder resin can be measured by a method described later in examples or an alternative method thereof.

The binder resin preferably has a softening point (Tm) of no greater than 100° C., and more preferably no greater than 95° C. As a result of Tm of the binder resin being no greater than 100° C. (more preferably no greater than 95° C.), fixability of the toner tends to be sufficient even during high speed fixing. Furthermore, in a situation in which Tm of the binder resin is no greater than 100° C. (more preferably no greater than 95° C.), partial softening of the toner cores tends to occur during a curing reaction of the shell layers when the shell layers are formed on the surfaces of the toner cores in an aqueous medium and, as a result, the toner cores tend to become round in shape due to surface tension. Tm of the binder resin can be measured by a method described later in the examples or an alternative method thereof.

Preferably, the binder resin is a thermoplastic resin. Preferable examples of thermoplastic resins in a situation in which the binder resin is a thermoplastic resin include styrene-based resins, acrylic acid-based resins (specific examples include copolymers of acrylic acid ester and methacrylic acid ester), olefin-based resins (specific examples include polyethylene resin and polypropylene resin), vinyl resins (specific examples include vinyl chloride resin, polyvinyl alcohol, vinyl ether resin, and N-vinyl resin), polyester resins, polyamide resins, and urethane resins. Copolymers of the above listed resins, that is, a copolymer in which a repeating unit is introduced into any of the resins (specific examples include styrene-acrylic acid-based resins and styrene-butadiene-based resins) are preferable as the binder resin. In order to improve dispersibility of a colorant in the toner core, chargeability of the toner, and fixability of the toner to a recording medium, styrene-acrylic acid-based resins or polyester resins are particularly preferable.

The following explains a styrene-acrylic acid-based resin that can be used as the binder resin. The styrene-acrylic acid-based resin is a copolymer of at least one type of styrene-based monomer and at least one type of acrylic acid-based monomer.

Preferable examples of styrene-based monomers that can be used to prepare the styrene-acrylic acid-based resin include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic acid-based monomers that can be used to prepare the styreneacrylic acid-based resin include (meth)acrylic acid, alkyl(meth)acrylates, and hydroxyalkyl(meth)acrylates. Specific examples of alkyl (meth)acrylates include methyl(meth)acrylate, ethyl(meth) acrylate, n-propyl(meth)acrylate, iso-propyl(meth)acrylate, n-butyl(meth)acrylate, iso-butyl(meth)acrylate, and 2-ethylhexyl(meth)acrylate. Specific examples of hydroxyalky (meth)acrylates include 2-hydroxyethyl(meth)acrylate, 3-hydroxypropyl(meth)acrylate, 2-hydroxypropyl(meth) acrylate, and 4-hydroxybutyl(meth)acrylate.

A hydroxyl group can be introduced into the styrene-acrylic acid-based resin by using a monomer having a hydroxyl group (specific examples include p-hydroxystyrene, m-hydroxystyrene, and hydroxyalkyl(meth)acrylates) in preparation of the styrene-acrylic acid-based resin. The hydroxyl value of the prepared styrene-acrylic acid-based resin can be adjusted by adjusting the amount of the monomer having the hydroxyl group that is used.

A carboxyl group can be introduced into the styrene-acrylic acid-based resin by using (meth)acrylic acid (monomer) in preparation of the styrene-acrylic acid-based resin. The acid value of the prepared styrene-acrylic acid-based resin can be adjusted by adjusting the amount of (meth) acrylic acid that is used.

In a situation in which the styrene-acrylic acid-based resin is used as the binder resin, the styrene-acrylic acid-based resin preferably has a number average molecular weight (Mn) of at least 2,000 and no greater than 3,000 in order to improve toner core strength and toner fixability. The styrene-acrylic acid-based resin preferably has a molecular weight distribution (i.e., a ratio Mw/Mn of mass average molecular weight (Mw) relative to number average molecular weight (Mn)) of at least 10 and no greater than 20. Mn and Mw of the styrene-acrylic acid-based resin can be measured by gel permeation chromatography.

The following describes a polyester resin that can be used as the binder resin. The polyester resin can be prepared through polymerization of a di-, tri-, or higher-hydric alcohol with a di-, tri-, or higher-basic carboxylic acid.

Examples of di-hydric alcohols that can be used to prepare the polyester resin include diols and bisphenols.

Preferable examples of diols that can be used to prepare the polyester resin include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols that can be used to prepare the polyester resin include bisphenol A, hydrogenated bisphenol A, bisphenol A ethylene oxide adduct, and bisphenol A propylene oxide adduct.

Examples of preferable tri- or higher-hydric alcohols that can be used to prepare the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable di-basic carboxylic acids that can be used to prepare the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acid (specific examples include n-butylsuccinic acid, isobutylsuccinic acid, n-octylsuccinic acid, n-dodecylsuccinic acid, and isododecylsuccinic acid), and alkenyl succinic acid (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids that can be used to prepare the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and Empol trimer acid.

Alternatively, an ester-forming derivative (specific examples include acid halides, acid anhydrides, and lower alkyl esters) of any of the di-, tri-, or higher-basic carboxylic acids listed above may be used. In the present description, the term "lower alkyl" refers to an alkyl group having a carbon number of 1-6.

The acid value and the hydroxyl value of the polyester resin can be adjusted by adjusting the amounts of alcohol and carboxylic acid used in preparation of the polyester resin. An increase in the molecular weight of the polyester resin tends to cause a decrease in the acid value and the hydroxyl value of the polyester resin.

In a situation in which the polyester resin is used as the binder resin, the polyester resin preferably has a number average molecular weight (Mn) of at least 1,000 and no greater than 2,000 in order to improve toner core strength and toner fixability. The polyester resin preferably has a molecular weight distribution (i.e., a ratio Mw/Mn of mass average molecular weight (Mw) relative to number average molecular weight (Mn)) of at least 9 and no greater than 21. Mn and Mw of the polyester resin can be measured by gel permeation chromatography.

(Colorant)

The toner cores may optionally contain a colorant. The colorant can be a commonly known pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass.

The toner cores may optionally contain a black colorant. The black colorant may for example be carbon black. In another example, the black colorant may be a colorant that is adjusted to a black color using a yellow colorant, a magenta colorant, and a cyan colorant.

The toner cores may optionally contain a non-black colorant such as a yellow colorant, a magenta colorant, or a cyan colorant.

Examples of yellow colorants that can be used include condensed azo compounds, isoindolinone compounds, anthraquinone compounds, azo metal complexes, methine compounds, and arylamide compounds. Specific examples of preferable yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of magenta colorants that can be used include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of preferable magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of cyan colorants that can be used include copper phthalocyanine compounds, anthraquinone compounds, and basic dye lake compounds. Specific examples of preferable cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

(Releasing Agent)

The toner cores may optionally contain a releasing agent. The releasing agent is for example used in order to improve fixability of the toner or resistance of the toner to being offset. In order to improve anionic strength of the toner cores, the toner cores are preferably prepared using an anionic wax. In order to improve toner fixability or offset resistance, the amount of the releasing agent is preferably at least 1 part by mass and no greater than 30 parts by mass relative to 100 parts by mass of the binder resin, and more preferably at least 5 parts by mass and no greater than 20 parts by mass.

Examples of preferable releasing agents that can be used include aliphatic hydrocarbon waxes (for example, low molecular weight polyethylene, low molecular weight polypropylene, polyolefin copolymer, polyolefin wax, microcrystalline wax, paraffin wax, and Fischer-Tropsch wax), oxides of aliphatic hydrocarbon waxes (for example, polyethylene oxide wax and block copolymer of polyethylene oxide wax), plant waxes (for example, candelilla wax, carnauba wax, Japan wax, jojoba wax, and rice wax), animal waxes (for example, beeswax, lanolin, and spermaceti), mineral waxes (for example, ozokerite, ceresin, and petrolatum), waxes having a fatty acid ester as a main component (for example, montanic acid ester wax and castor wax), and waxes in which a fatty acid ester is partially or fully deoxidized (for example, deoxidized carnauba wax). A single releasing agent such as listed above may be used or a combination of two or more releasing agents may be used.

A compatibilizer may optionally be added to the toner cores in order to improve compatibility of the binder resin and the releasing agent.

(Charge Control Agent)

The toner cores may optionally contain a charge control agent. The charge control agent is for example used in order to improve charge stability or a charge rise characteristic of the toner. The charge rise characteristic of the toner is an indicator as to whether or not the toner can be charged to a specific charge level in a short period of time.

Anionic strength of the toner cores can be increased by including a negatively chargeable charge control agent in the toner cores. Cationic strength of the toner cores can be increased by including a positively chargeable charge control agent in the toner cores. In a situation in which sufficient charge of the toner is ensured, the charge control agent is not necessarily contained in the toner core.

(Magnetic Powder)

The toner cores may optionally contain a magnetic powder. Examples of preferable magnetic powder materials that can be used include ferromagnetic metals (specific examples include iron, cobalt, and nickel), alloys of such ferromagnetic metals, ferromagnetic metal oxides (specific examples include ferrite, magnetite, and chromium dioxide), and materials subjected to ferromagnetization (for example, heat treatment). A single type of magnetic powder may be used or a combination of a plurality of types of magnetic powder may be used.

The magnetic powder is preferably subjected to surface treatment in order to inhibit elution of metal ions (for example, iron ions) from the magnetic powder. In a situation in which shell layers are formed on the surfaces of toner cores under acidic conditions, elution of metal ions to the surfaces of the toner cores causes the toner cores to adhere to one another further readily. Adhesion of the toner cores to one another can be inhibited by inhibiting elution of metal ions from the magnetic powder.

[Shell Layers]

The toner according to the present embodiment has feature (2). The shell layer includes a thermosetting portion substantially composed of a water-insoluble thermosetting resin and a thermoplastic portion substantially composed of a water-insoluble thermoplastic resin.

Preferable examples of water-insoluble thermoplastic resins composing the thermoplastic portion of the shell layer include acrylic acid-based resins, vinyl resins, urethane resins, polyester resins, and copolymers thereof (specific examples include a styrene-acrylic acid-based copolymer, a silicone-acrylic acid-based graft copolymer, and an ethylene-vinyl alcohol copolymer). In order to improve high-temperature preservability, charge decay characteristics, resistance to drum adhesion, and transfer efficiency of the toner, the thermoplastic portion of the shell layer preferably contains as a water-insoluble thermoplastic resin, one or more resins selected from the group consisting of acrylic acid-based resins and styrene-acrylic acid-based resins.

Preferable example of water-insoluble thermosetting resins composing the thermosetting portion of the shell layer include cross-linking acrylic acid-based resins, cross-linking vinyl resins, cross-linking urethane resins, cross-linking polyester resins, epoxy resins, and copolymers thereof (specific example is cross-linking styrene-acrylic acid-based resin).

Preferable examples of acrylic acid-based monomers that can be used for synthesis of either or both the water-insoluble thermoplastic resin in the thermoplastic portion and the water-insoluble thermosetting resin in the thermosetting portion include (meth)acrylic acid, (meth)acryl amide, alkyl(meth)acrylates, hydroxyalkyl(meth)acrylates, and aryl(meth)acrylates. Preferable examples of alkyl(meth) acrylates include methyl(meth)acrylate, ethyl(meth)acrylate, n-propyl(meth)acrylate, iso-propyl(meth)acrylate, n-butyl(meth)acrylate, iso-butyl(meth)acrylate, and 2-ethylhexyl(meth)acrylate. Preferable examples of hydroxyalkyl (meth)acrylates include 2-hydroxyethyl(meth)acrylate, 3-hydroxypropyl(meth)acrylate, 2-hydrolypropyl(meth) acrylate, and 4-hydroxybutyl(meth)acrylate. A preferable example of aryl(meth)acrylates is phenyl(meth)acrylate.

Preferable examples of styrene-based monomers that can be used for synthesis of either or both the water-insoluble thermoplastic resin in the thermoplastic portion and the water-insoluble thermosetting resin in the thermosetting portion include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

A curing agent may be optionally used in order to increase cross-linking density of a resin. For example, in order to improve high-temperature storage resistance, charge decay characteristics, resistance to drum adhesion, and transfer efficiency of the toner, it is particularly preferable that the thermosetting portion of the shell layer contains an epoxy resin as the water-insoluble thermosetting resin. The epoxy resin can be synthesized by three-dimensional cross-linking through a reaction of an epoxy compound having an epoxy group (preferably, an alicyclic epoxy compound) and a curing agent thereof.

A thermosetting resin can be obtained by adding a curing agent to a thermoplastic monomer. The thermoplastic monomer is a monomer that is to become a thermoplastic resin through homopolymarization (specific examples include an acrylic acid-based monomer, and a styrene-based monomer) or a monomer that is to become a thermoplastic resin through condensation polymerization (for example, a combination of an alcohol and carboxylic acid that is to become a polyester resin through condensation polymerization). Suitable examples of curing agents that can be used include aromatic divinyl compounds (specific examples include divinylbenzene and divinylnaphthalene), carboxylic acid esters having two double bonds (specific example is ethylene glycol diacrylate), divinyl compounds (specific examples include divinyl aniline, divinyl ether, divinylsulfide, and divinylsulpone), and compounds having three or more vinyl groups.

[External Additive]

An external additive may optionally be caused to adhere to the surfaces of the toner particles as necessary. The external additive is used to improve fluidity or handling property of the toner, for example. In order to improve fluidity or handling property of the toner, the amount of the external additive is preferably at least 0.5 parts by mass and no greater than 10 parts by mass relative to 100 parts by mass of the toner mother particles. In order to improve fluidity or handling property of the toner, the external additive preferably has a particle size of at least 0.01 μm and no greater than 1.0 μm.

Suitable examples of external additives that can be used include particles of metal oxides (specific examples include alumina, titanium oxide, magnesium oxide, zinc oxide, strontium titanate, and barium titanate) and particles of silica. A single type of external additive may be used or a combination of a plurality of types of external additive may be used in combination.

[Toner Manufacturing Method]

The following describes a method for manufacturing the toner according to the present embodiment. First of all, toner cores are prepared. Then, thermoplastic particles substantially composed of a water-insoluble thermoplastic resin are prepared. Subsequently, the thermoplastic particles are caused to adhere to the surfaces of the toner cores by a mechanical force to obtain intermediate particles each having the toner core and the thermoplastic particles. Subsequently, while the resultant intermediate particles are allowed to flow in an air flow, a material for synthesis of a water-insoluble thermosetting resin is sprayed toward the intermediate particles, thereby forming shell layers on the surfaces of the toner cores.

Further description will be made below about the method for manufacturing the toner according to the present embodiment by referencing more detailed examples.

(Toner Core Production Process)

Examples of preferable toner core production processes include an aggregation method and a pulverization method. The pulverization method is more preferable for toner core production.

An example pulverization method will be described below. First, a binder resin and an internal additive (for example, at least one of a colorant, a releasing agent, a charge control agent, and a magnetic powder) are mixed. Next, the resultant mixture is melted and kneaded. The resultant melted and kneaded mixture is then pulverized and classified. Through the above processes, toner cores having a desired particle size are produced.

An example aggregation method will be described below. First, respective particulates of a binder resin, a releasing agent, and a colorant are caused to aggregate in an aqueous medium to obtain aggregated particles containing the binder resin, the releasing agent, and the colorant. Subsequently, the resultant aggregated particles are heated to cause coalescence of the components contained in the aggregated particles. As a result, a dispersion of the toner cores is obtained. Thereafter, unnecessary substances (surfactant and the like) are removed from the dispersion of the toner cores to obtain the toner cores.

(Shell Layer Formation Process)

Following describes an example method of forming thermoplastic particles. First, a thermoplastic monomer (for example, an acrylic acid-based monomer and/or a styrene-based monomer) is polymerized in for example a liquid to obtain a suspension of resin particles. Next, the resultant suspension of the resin particles is freeze-dried. Through the above processes, thermoplastic particles are obtained.

The resultant thermoplastic particles are caused to adhere to the surfaces of the toner cores. The use of a surface modifier (for example, Hybridization System (registered Japanese trademark) NHS-1 produced by NARA MACHINERY CO., LTD.) can cause the thermoplastic particles to adhere to the surfaces of the toner cores by a mechanical force. Specifically, an air flow is created in a flow channel of the surface modifier to disperse the toner cores and the resin particles in the air flow. The toner cores and the resin particles flow along the air flow. While the air in the flow channel is stirred at a predetermined rotational speed (for example, a speed of at least 2,000 rpm and no greater than 10,000 rpm), the toner cores and the resin particles are detained in the flow channel for a predetermined time period (for example, a time period of at least 5 minutes and no greater than 1 hour). When the toner cores and the resin particles are stirred in the flow channel to impact on one another, the thermoplastic particles are caused to adhere to the surfaces of the toner cores by the impact force. Through the above processes, intermediate particles are obtained.

Subsequently, while the resultant intermediate particles are allowed to flow in the air flow, a material for synthesis of a water-insoluble thermosetting resin (for example, an epoxy compound and a curing agent thereof) is sprayed toward the intermediate particles. Then, while the contents in the flow channel is stirred at a predetermined rotational speed (for example, a speed of at least 2,000 rpm and no greater than 10,000 rpm), the toner cores and the resin particles are detained in the flow channel for a predetermined time period (for example, a time period of at least 5 minutes and no greater than 1 hour). Stirring generates heat to increase the internal temperature of the flow channel. The temperature increase is thought to promote melting and spreading of the resin particles on the surfaces of the toner cores and resinification of the sprayed material. Through the above processes, the shell layer is formed on the surface of each toner core such that toner mother particles are obtained.

Subsequently, the resultant toner mother particles are washed. Following the washing, the washed toner mother particles are dried. Thereafter, the toner mother particles are mixed with an external additive as necessary to cause the external additive to adhere to the surfaces of the toner mother particles. The above completes the manufacture of a toner containing a large number of toner particles. The details and sequence of the above toner manufacturing method may be changed freely as appropriate in accordance with requirements of the toner, such as in terms of composition and properties. Various steps may be omitted as appropriate. In a situation in which an external additive is not caused to adhere to the surfaces of the toner mother particles (i.e., the external addition process is omitted), the toner mother particles and the toner particles are equivalent. A material used to form the toner cores (hereinafter referred to as a toner core material) and the shell material are not limited to the aforementioned compounds (for example, monomers for resin synthesis). For example, any derivative of the above listed compounds may be used as the toner core material or the shell material as necessary. Alternatively, a prepolymer may be used instead of the monomer. In order to efficiently produce the toner, preferably a large number of toner particles are formed at the same time.

EXAMPLES

Following describes Examples of the present disclosure. Table 1 shows details of toners A-1 to A-3, B-1 to B-4, C, D, and E (electrostatic latent image developing toners) of Examples and Comparative Examples.

TABLE 1

| | First resin | | | | Second resin | | | |
|---|---|---|---|---|---|---|---|---|
| Toner | Property | Particle size [nm] | Tg [° C.] | Amount | Property | Amount | Detention time [min.] | Curing agent [g] |
| A-1 | Water-insoluble | 100 | 71 | 2 g | Water-insoluble | 2 g | 10 | 0.5 |
| A-2 | Thermoplastic | 250 | 68 | 2 g | Thermosetting | | | |
| A-3 | | 102 | 103 | 2 g | | | | |
| B-1 | Water-insoluble | 100 | 71 | 2 g | Water-insoluble | 2 g | 30 | 0.5 |
| B-2 | Thermoplastic | | | 2 g | Thermosetting | | 10 | 1.5 |
| B-3 | | | | 4 g | | | | 0.5 |
| B-4 | | | | 2 g | | 3 g | | 1.5 |
| C | Water-insoluble Thermoplastic | 100 | 71 | 2 g | Water-insoluble Thermoplastic | — | 10 | — |
| D | Water-insoluble Thermoplastic | 89 | 72 | 15 ml | Water-soluble Thermosetting | 0.35 mL | — | — |
| E | Water-soluble Thermoplastic | — | — | 27 mL | Water-soluble Thermosetting | 0.35 mL | — | — |

Following sequentially describes respective manufacturing methods of the toners A-1 to A-3, B-1 to B-4, C, D, and E, an evaluation method, and evaluation results. In evaluations in which errors may occur, an evaluation value was calculated by calculating the arithmetic mean of an appropriate number of measured values in order to ensure that any errors were sufficiently small. Respective methods of measuring a glass transition point (Tg) and a softening point (Tm) are as follows unless otherwise stated.

<Tg Measuring Method>

Tg of a measurement sample (for example, a binder resin of toner cores or resin particles used for shell layer formation) was measured by plotting a heat absorption curve of the measurement sample using a differential scanning calorimeter (DSC-6220 produced by Seiko Instruments Inc.) and calculating Tg from a point of change in specific heat on the heat absorption curve.

<Tm Measuring Method>

An S-shaped curve (horizontal axis: temperature, vertical axis: stroke) was plotted by setting a sample (for example, a binder resin) in a capillary rheometer (CFT-500D produced by Shimadzu Corporation) and causing melt-flow of 1 $cm^3$ of a sample under conditions of a die pore diameter of 1 mm, a plunger load of 20 $kg/cm^2$, and a heating rate of 6° C./minute. Subsequently, Tm of the sample was read from the plotted S-shaped curve. Tm of the measurement sample (binder resin) is a temperature on the plotted S-shaped curve corresponding to a stroke value of $(S_1+S_2)/2$, where $S_1$ represents a maximum stroke value and $S_2$ represents a base line stroke value at low temperatures.

[Method of Manufacturing Toner A-1]

(Toner Core Production Process)

A FM mixer produced by Nippon Coke & Engineering Co., Ltd. was used to mix 750 g of a low-viscosity polyester resin (Tg=38° C., Tm=65° C.), 100 g of an intermediate-viscosity polyester resin (Tg=53° C., Tm=84° C.), 150 g of a high-viscosity polyester resin (Tg=71° C., Tm=120° C.), 55 g of a carnauba wax (Carnauba Wax No. 1 produced by S. KATO & CO.), and 40 g of a colorant (phthalocyanine blue, KET BLUE 111 produced by DIC Corporation) at a rotational speed of 2400 rpm.

Subsequently, the resultant mixture was melt-knead using a two-screw extruder (PCM-30 produced by Ikegai Corp.) under conditions of a material input rate of 5 kg/hour, a shaft rotational speed of 160 rpm, and a temperature setting range of 100° C. to 130° C. The resultant melt-knead product was cooled then. The cooled melt-knead produce was coarsely pulverized using a pulverizer (Rotoplex (registered Japanese trademark) 16/8 produced by Hosokawa Micron Corporation). The coarsely pulverized product was finely pulverized using a jet mill (Supersonic Jet Mill I produced by Nippon Pneumatic Mfg. Co., Ltd.). Next, the finely pulverized product was classified using a classifier (Elbow Jet EJ-LABO produced by Nittetsu Mining Co., Ltd.). As a result, toner cores having a volume median diameter (D50) of 6 μm were obtained.

(Shell Layer Formation Process)

A three-necked flask equipped with a thermometer and a stirring impeller and having a capacity of 1 L was set in a water bath. Then, 875 mL of ion exchanged water at a temperature of 30° C. and 75 mL of an anion surfactant (LATEMUL (registered Japanese trademark) WX produced by Kao Corporation, sodium polyoxyethylene alkyl ether sulfate, solid concentration 26% by mass) were added into the flask. The internal temperature of the flask was subsequently increased to 80° C. using a water bath. Next, two liquids (a first liquid and a second liquid) were dripped into the flask at a temperature of 80° C. over five hours. The first liquid was a mixed liquid of 17 mL of a styrene and 3 mL of a butyl acrylate. The second liquid was a solution of 0.5 g of potassium persulfate dissolved in 30 mL of ion exchanged water.

Subsequently, a suspension of resin particles was obtained by stirring the flask contents for 2 hours under condition of a temperature of 80° C. and a rotational speed of 100 rpm to polymerize the flask contents. Then, the resultant suspension was freeze-dried to obtain resin particles (a powder). Hereinafter, the resultant resin particles were referred as resin particles A. The number average particle size and Tg of the resin particles A were 100 nm and 71° C., respectively.

The resin particles A obtained through the above were caused to adhere to the surfaces of the toner cores using a surface modifier. The surface modifier used was an apparatus in which a fluid nozzle is mounted on top of a container of Hybridization System (registered Japanese trademark) NHS-1 produced by NARA MACHINERY CO., LTD. (power 5.5 kW, charge 200 g/batch, rotor diameter 230 mm). The surface modifier causes surface modification or conjugation of the surface of a sample (mother particles) with particulates (child particles) by drying by an impact force as a main force while dispersing the sample in a high-speed air flow. The particulates (child particles) are secured to the surface of the sample (surfaces of the mother particles).

Specifically, while an air flow was created in a flow channel of the surface modifier, 200 g of toner cores produced through the above processes and 2 g of resin particles A produced through the above processes were dispersed in the air flow at room temperature (25° C.). Then, using the surface modifier, the toner cores and the resin particles A were detained for 10 minutes while the inside of the flow channel was stirred at a rotational speed of 6,000 rpm.

Subsequently, 2 g of a difunctional alicyclic epoxy resin compound (CELLOXIDE (registered Japanese trademark) 2021P produced by Daicel Corporation, 3',4'-epoxycyclohexane)methyl 3,4-epoxycyclohexylcarboxylate) was sprayed in the air flow using a fluid nozzle while stirring at a rotational speed of 6,000 rpm was continued and the toner cores and the resin particles A were detained for additional 5 minutes. Then, 0.5 g of an epoxy resin curing agent (jER CURE (registered Japanese trademark) LV 11 produced by Mitsubishi Chemical Corporation) was sprayed in the air flow while stirring at a rotational speed of 6,000 rpm was continued and the core particles and the resin particles A were detained for additional 10 minutes. Hereinafter, the detention time at that time is referred to as a detention time after curing agent addition. Also, a process from addition (spray) of the difunctional alicyclic epoxy resin compound to detention completion after addition of the epoxy resin curing agent is referred to as a curing agent adding process.

Through the above processes, the shell layers were formed on the surfaces of the toner cores such that toner mother particles were obtained. Stirring generated heat to increase the internal temperature of the flow channel up to approximately 45° C.

(Washing Step)

The toner mother particles obtained through the above processes were dispersed in ion exchanged water to obtain a dispersion of the toner mother particles. Then, a wet cake of the toner mother particles was collected from the dispersion of the toner mother particles by filtration (solid-liquid separation) using a Buchner funnel. Thereafter, the collected wet cake of the toner mother particles was re-dispersed in ion exchanged water. Further, dispersion and filtration were repeated three times for washing the toner mother particles.

(Drying Step)

A slurry of the toner mother particles was prepared by dispersing the washed wet cake of the toner mother particles in 50% by mass concentration aqueous ethanol solution. The prepared slurry was then fed into a continuous type surface modifier (Coatmizer (registered Japanese trademark) produced by Freund Corporation) to dry the toner mother particles in the slurry under conditions of a hot air temperature of 45° C. and a blower air flow rate of 2 $m^3$/min., thereby yielding dry toner mother particles (a powder).

(External Addition Step)

Subsequently, the resultant toner mother particles were subjected to external addition. Specifically, an FM mixer (product of Nippon Coke & Engineering Co., Ltd.) having a capacity of 10 L was used to mix 100 parts by mass of the toner mother particles resulting from the drying step and 1 parts by mass of dry silica particulates (AEROSIL (registered Japanese trademark) REA90 produced by Nippon Aerosil Co., Ltd.) for 5 minutes to cause an external additive (silica particles) to adhere to the surfaces of the toner mother particles. Thereafter, the resultant toner was sifted using a 200 mesh (opening 75 μm) sieve to yield a toner A-1.

[Method of Manufacturing Toner A-2]

The toner A-2 was prepared according to the same method as for the toner A-1 in all aspects other than that resin particles B were used instead of the resin particles A. The resin particles B was prepared according to the same method as for the resin particles A in all aspects other than that the amount of the anion surfactant that was used was changed from 75 mL to 25 mL. The number average particle size and Tg of the resin particles B were 250 nm and 68° C., respectively.

[Method of Manufacturing Toner A-3]

The toner A-3 was prepared according to the same method as for the toner A-1 in all aspects other than that resin particles C were used instead of the resin particles A. The resin particles C were produced according to the same method as for the resin particles A in all aspects other than that 100 mL of a styrene was used as the first liquid instead of a mixed liquid of 17 mL of styrene and 3 mL of butyl acrylate. The number average particle size and Tg of the resin particles C were 102 nm and 103° C., respectively.

[Method of Manufacturing Toner B-1]

The toner B-1 was prepared according to the same method as for the toner A-1 in all aspects other than that the detention time after curing agent addition was changed from 10 minutes to 30 minutes.

[Method of Manufacturing Toner B-2]

The toner B-2 was prepared according to the same method as for the toner A-1 in all aspects other than that the amount of the epoxy resin curing agent that was used was changed from 0.5 g to 1.5 g.

[Method of Manufacturing Toner B-3]

The toner B-3 was prepared according to the same method as for the toner A-1 in all aspects other than that the amount of the resin particles A that was used was changed from 2 g to 4 g.

[Method of Manufacturing Toner B-4]

The toner B-4 was prepared according to the same method as for the toner A-1 in all aspects other than that the amount of the difunctional alicyclic epoxy resin compound that was used was changed from 2 g to 3 g and the amount of the epoxy resin curing agent that was used was changed from 0.5 g to 1.5 g.

[Method of Manufacturing Toner C]

The toner C was prepared according to the same method as for the toner A-1 in all aspects other than that the curing agent adding process was omitted.

[Method of Manufacturing Toner D]

The method of manufacturing the toner D used the toner cores used in manufacturer of the toner A-1 and the suspension of the resin particles obtained in preparation of the resin particles A. In the method of manufacturing the toner D, freeze-drying was not carried out on the resultant suspension of the resin particles. The number average particle size and Tg of the resin particles used in the method of manufacturing the toner D were 89 nm and 72° C., respectively.

A three-necked flask equipped with a thermometer and a stirring impeller and having a capacity of 1 L was set in a water bath, and 300 mL of ion exchanged water was added into the flask. Thereafter, the internal temperature of the flask was kept at 30° C. using the water bath. Subsequently, a dilute hydrochloric acid was added into the flask to adjust the pH of the flask contents to 4. Then, 0.35 mL of a hexamethylolmelamine prepolymer (MIRBANE (registered Japanese trademark) Resin SM-607 produced by Showa Denko K. K., solid concentration 80% by mass) and 15 mL of the suspension of the resin particles were added into the flask. The methylol melamine was caused to melt in the flask to obtain an aqueous solution of a shell material.

Subsequently, 300 g of the toner cores were added to the resultant aqueous solution of the shell material and the flask contents were stirred for 1 hour at a rotational speed of 200 rpm. Thereafter, 300 mL of ion exchanged water was added into the flask. Then, the internal temperature of the flask was increased to 70° C. at a rate of 1° C./min while the flask contents were stirred at a rotational speed of 100 rpm.

Subsequently, the flask contents were stirred for 2 hours under conditions of a temperature of 70° C. and a rotational speed of 100 rpm. Then, sodium hydroxide was added into the flask to adjust the pH of the flask contents to 7. The flask contents were then cooled to room temperature (approximately 25° C.), thereby obtaining a toner mother particle-containing dispersion.

Through a washing process, a drying process, and an external adding process similar to those in the method of manufacturing the toner A-1, the toner D was obtained. Note that dispersion and filtration were repeated 5 times for washing the toner mother particles.

[Method of Manufacturing Toner E]

The toner E was prepared according to the same method as for the toner D in all aspects other than that 27 mL of an aqueous solution of an acrylic amide resin (BECKAMINE (registered Japanese trademark) A-1 produced by DIC Corporation, solid concentration 11% by mass) was used instead of 15 mL of the resin particle-containing suspension.

[Evaluation Method]

The following describes an evaluation method of each sample (toners A-1 to A-3, B-1 to B-4, C, D, and E).

(High-Temperature Preservability)

A 20 mL polyethylene container containing 2 g of a sample (toner) was left for 3 hours in a thermostatic chamber set to 60° C. to obtain an evaluation toner in the container.

Next, the evaluation toner was placed on a 100 mesh (opening 150 μm) sieve of known mass. The mass of the sieve and the evaluation toner was measured in order to obtain the mass of the evaluation toner prior to sifting. Next, the sieve was set in a powder tester (product of Hosokawa Micron Corporation) and caused to vibrate in accordance with a manual of the powder tester at a rheostat level of 5 for 30 seconds in order to sift the evaluation toner. After sifting, the mass of toner that did not pass through the sieve was measured by measuring the mass of the toner remaining on the sieve and the sieve. The mass of the toner pre-sifting and the mass of toner post-sifting (i.e., the mass of toner that did not pass through the sieve) were used to calculate a degree of aggregation (unit: % by mass) of the sample (toner) based on the following equation.

$$\text{Degree of aggregation}=100\times\text{toner mass post-sifting}/\text{toner mass pre-sifting.}$$

High-temperature preservability of the sample (toner) was evaluated based on the calculated degree of aggregation, in accordance with the following standard.

Good: Degree of aggregation of no greater than 50% by mass

Poor: Degree of aggregation of greater than 50% by mass (Charge Decay Characteristics)

The charge decay constant of the sample (toner) was measured in accordance with JIS C 61340-2-1 using an electrostatic diffusivity measuring device (NS-D100 produced by Nano Seeds Corporation). The following describes the method of measuring the charge decay constant of a toner.

A sample (toner) was placed into a measurement cell. The measurement cell was a metal cell with a recess having an inner diameter of 10 mm and a depth of 1 mm. The sample was filled in the recess of the cell by being thrust from above using slide glass. Sample brimming over the cell was removed by reciprocating the slide glass on the surface of the cell. At least 0.04 g and no greater than 0.06 g of sample was filled in the cell.

Subsequently, the measurement cell in which the sample (toner) was filled was left for 12 hours in an environment at a temperature of 32° C. and a humidity of 80% RH. Thereafter, the measurement cell was grounded and placed in an electrostatic diffusivity measuring device. Ions were then supplied to the sample through corona discharge to charge the sample. The charging period was 0.5 seconds. After elapse of 0.7 seconds from completion of corona discharge, the surface potential of the sample was measured continuously. The charge decay constant (charge decay rate) a was calculated based on an equation $V=V_0\exp(-\alpha\sqrt{t})$ using the measured surface potentials. In the equation, V, $V_0$, and t represent a surface potential [V], an initial surface potential [V], and a decay time [second], respectively.

The charge decay characteristics of the sample (toner) were evaluated based on the calculated charge decay constant, in accordance with the following standard.

Good: Charge decay constant of no greater than 0.010

Fair: Charge decay constant of greater than 0.010 and no greater than 0.100

Poor: Charge decay constant of greater than 0.100

(Transfer Efficiency and Resistance to Drum Adhesion)

A two-component developer was prepared by mixing 100 parts by mass of a developer carrier (carrier for TASKalfa5550ci produced by KYOCERA Document Solutions Inc.) and 10 parts by mass of a toner for 30 minutes using a ball mill. An image was formed using the prepared two-component developer for evaluation of transfer efficiency and resistance to drum adhesion. An evaluation apparatus used was a multifunction peripheral (TASKalfa5550ci produced by KYOCERA Document Solutions Inc.). The two-component developer prepared as above was set in a developing device of the evaluation apparatus, and the sample (toner for replenishment) was set in a toner container of the evaluation apparatus.

For evaluation of transfer efficiency, continuous printing was carried out on 10,000 recording mediums (A4-size printing paper) at a coverage rate of 5% using the above evaluation apparatus in an environment at a temperature of 32° C. and a humidity of 80% RH. Thereafter, each mass of consumed toner and collected toner was measured and transfer efficiency (unit: % by mass) was calculated based on the following equation. The consumed toner was toner that was discharged from the toner container in the sample (toner) set in the toner container. The collected toner was toner that was not transferred to a recording medium in the consumed toner.

$$\text{Transfer efficiency}=100\times(\text{consumed toner mass}-\text{collected toner mass})/\text{consumed toner mass}$$

Transfer efficiency of the sample was evaluated, in accordance with the following standard.

Good: Transfer efficiency of at least 90% by mass

Fair: Transfer efficiency of at least 80% by mass and less than 90% by mass

Poor: Transfer efficiency of less than 80% by mass

For evaluation of resistance to drum adhesion, continuous printing was carried out on 10,000 recording mediums (A4-size printing paper) at a coverage rate of 5% using the above evaluation apparatus in an environment at a temperature of 32° C. and a humidity of 80% RH. Thereafter, a solid image was formed in an unfixed state on an evaluation sheet (ColorCopy (registered Japanese trademark) produced by Mondi, A4, 90 g/m$^2$) under a condition of a toner application amount of 0.5 mg/cm$^2$. Then, the solid image on the evaluation sheet was observed visually.

The solid image was evaluated, in accordance with the following standard.

Good: No dash mark observed

Poor: A dash mark observed

The term "dash mark" means an image defect that may be caused due to adhesion of a toner on a surface of a photosensitive drum.

[Evaluation Results]

Table 2 shows evaluation results for each of the sample toners A-1 to A-3, B-1 to B-4, C, D, and E. Table 2 lists high-temperature preservability (degree of aggregation), charge decay characteristics (charge decay constant), resistance to drum adhesion (presence or absence of a dash mark), and transfer efficiency of each of the toners. In the column as for evaluation results of resistance to drum adhesion in Table 2, the number "300" means that a dash mark was observed in the 300$^{th}$ printed sheet.

TABLE 2

| | Toner | Preservability [wt. %] | Charge decay | Resistance to drum adhesion | Transfer efficiency [wt. %] |
|---|---|---|---|---|---|
| Example 1 | A-1 | 45 | 0.010 | Good | 90 |
| Example 2 | A-2 | 47 | 0.007 | Good | 96 |
| Example 3 | A-3 | 12 | 0.010 | Good | 90 |
| Example 4 | B-1 | 25 | 0.008 | Good | 93 |
| Example 5 | B-2 | 35 | 0.010 | Good | 93 |
| Example 6 | B-3 | 25 | 0.007 | Good | 95 |
| Example 7 | B-4 | 11 | 0.010 | Good | 90 |
| Comparative Example 1 | C | 73 (Poor) | 0.009 | 300 (Poor) | 75 (Poor) |
| Comparative Example 2 | D | 25 | 0.015 (Fair) | Good | 85 (Fair) |
| Comparative Example 3 | E | 47 | 0.340 (Poor) | Good | 43 (Poor) |

As indicated in Table 2, each of the toners A-1 to A-3 and B-1 to B-4 (respective toners in Examples 1-7) was excellent in high-temperature preservability, charge decay characteristics, resistance to drum adhesion, and transfer efficiency. The respective toners in Examples 1-7 had features (1) and (2) as described above. Each of the toners according to Examples 1-7 had a configuration similar to that illustrated in FIG. 2.

What is claimed is:

1. A toner comprising a plurality of toner particles each including a core and a shell layer disposed over a surface of the core, wherein the shell layer includes a thermosetting portion substantially composed of a water-insoluble thermosetting resin and a thermoplastic portion substantially composed of a water-insoluble thermoplastic resin, at least a part of the thermoplastic portion has a shape of a film with projections and recesses and is located on the surface of the core, and at least a part of the thermosetting portion is located on the thermoplastic portion and has a shape of a film along the shape of the thermoplastic portion.

2. The toner according to claim 1, wherein the thermoplastic portion of the shell layer is partially embedded in the core.

3. The toner according to claim 1, wherein the thermosetting portion of the shell layer has a surface in granular appearance.

4. The toner according to claim 1, wherein the thermosetting portion of the shell layer contains an epoxy resin as the water-insoluble thermosetting resin.

5. The toner according to claim 1, wherein the thermoplastic portion of the shell layer contains as the water-insoluble thermoplastic resin, at least one resin selected from a group consisting of acrylic acid-based resins and styrene-acrylic acid-based resins.

6. The toner according to claim 1, wherein the shell layer contains no water-soluble resin.

7. The toner according to claim 1, wherein the thermoplastic portion of the shell layer is in form of particles of the water-insoluble resin melt over the surface of the core.

8. The toner according to claim 1, wherein the thermosetting portion of the shell layer is a coating film.

9. The toner according to claim 1, wherein the thermosetting portion of the shell layer has a coverage on a surface region of the core higher than the thermoplastic portion of the shell layer.

10. The toner according to claim 1, wherein the thermoplastic portion of the shell layer covers 50% or more area in an entire surface region of the core, and the thermosetting portion of the shell layer covers directly or indirectly 80% or more area in the entire surface region of the core.

11. The toner according to claim 1, wherein the thermoplastic portion of the shell layer is partially embedded in the core, the thermosetting portion of the shell layer has a surface in granular appearance, and the thermoplastic portion of the shell layer is in form of particles of the water-insoluble resin melt over the surface of the core.

12. The toner according to claim 1, wherein the thermosetting portion of the shell layer contains an epoxy resin as the water-insoluble thermosetting resin, the thermoplastic portion of the shell layer contains as the water-insoluble thermoplastic resin, at least one resin selected from a group consisting of acrylic acid-based resins and styrene-acrylic acid-based resins, and the shell layer contains no water-soluble resin.

13. The toner according to claim 1, wherein the thermosetting portion of the shell layer contains a cured material that is a difunctional alicyclic epoxy resin compound cured by an epoxy resin curing agent.

14. The toner according to claim 1, wherein a part of the thermosetting portion of the shell layer located on the thermoplastic portion of the shell layer has a shape of a film along the shape of the thermoplastic portion and enters into recesses of the thermoplastic portion.

15. The toner according to claim 1, wherein the surface of the core is partially uncovered by the thermoplastic portion, and the thermosetting portion of the shell layer is formed on both the surface of the core and a surface of the thermoplastic portion.

16. The toner according to claim 1, wherein most part of the thermosetting portion of the shell layer is formed on the thermoplastic portion of the shell layer.

* * * * *